US007274796B2

(12) United States Patent
Chan

(10) Patent No.: US 7,274,796 B2
(45) Date of Patent: Sep. 25, 2007

(54) REINFORCED SPEAKER DAMPER

(76) Inventor: Yen-Chen Chan, No. 120, Min An East Road, Hsin Chuang City, Taipei Hsien (TW)

( * ) Notice: Subject to any disclaimer, the term of this patent is extended or adjusted under 35 U.S.C. 154(b) by 479 days.

(21) Appl. No.: 10/899,363

(22) Filed: Jul. 24, 2004

(65) Prior Publication Data

US 2006/0018501 A1 Jan. 26, 2006

(51) Int. Cl.
*H04R 25/00* (2006.01)

(52) U.S. Cl. ..... 381/404; 381/428; 29/594

(58) Field of Classification Search ..... 381/403–404, 381/423–424, 426, 428; 181/163–173; 29/594
See application file for complete search history.

(56) References Cited

U.S. PATENT DOCUMENTS 6,700,988 B2 * 3/2004 Wu ..... 381/404
6,853,734 B2 * 2/2005 Sahyoun ..... 381/404

* cited by examiner

*Primary Examiner*—Suhan Ni

(57) ABSTRACT

A reinforced speaker damper includes a ring-shaped damper body made of woven fabric in the form of a mesh and press-molded to form a wavy cross-section having alternating ridges and troughs. A plurality of reinforces is attached to the damper body. Each reinforce includes a woven fabric in the form of a mesh with rectangular openings extending in a direction different from that of the damper body and having a wavy cross-section for closely fitting over the wavy configuration of the damper body. Each reinforce is fixed to the damper body by for example sewing and extends between inner and outer circumferences of the ring of the damper body.

8 Claims, 5 Drawing Sheets

REINFORCED SPEAKER DAMPER

BACKGROUND OF THE INVENTION

1. Field of the Invention

The present invention relates generally to a damper of a loudspeaker, and in particular to a reinforce of a speaker damper that helps preventing cracking and/or breaking of the speaker damper and thus extending life span of the damper.

2. The Related Art

A conventional speaker damper, as particularly shown in FIG. 4 of the attached drawings, generally designated with reference numeral 5, comprises a ring-shaped body defining a central hole 51. The ring is made by press-molding a woven fabric and has a wavy cross-section. The fabric is made in a mesh form. Also referring to FIGS. 5 and 5A, the damper 5 is positioned inside a speaker 6 with the central hole 51 fit over a coil 61 of the speaker 6. When the speaker 6 is actuated, a magnetic field is excited inside the coil 61, which causes vibration of a film of the speaker 6. The vibration becomes sound wave transmitted through air. The propagation of sound wave reaches the damper 5, causing vibration of the ring of the damper 5.

The wavy cross-section of the ring of the damper 5 provides a mechanism for buffering the impact caused on the ring of the damper 5 by the sound wave. However, long-term high-frequency vibration of the damper may still cause fatigue, which leads to cracking and/or breaking of the damper ring, particularly along an inner circumference of the central hole, and eventually failure of the damper. The life span of the damper is often shortened due to such cracking or breaking of the damper ring at the inner circumference and the sound quality of the speaker is adversely affected.

Thus the present invention is aimed to provide a reinforced speaker damper to overcome the drawbacks of the conventional speaker dampers.

SUMMARY OF THE INVENTION

A primary objective of the present invention is to provide a speaker damper having a reinforce, which enhances durability of the damper against failure cauised by cracking and/or breaking due to fatigue and thus extends the life span of the speaker damper.

In accordance with the present invention, to realize the above objective, a reinforced speaker damper comprises a ring-shaped damper body made of wove fabric in the form of a mesh and press-molded to form a wavy cross-section having alternating ridges and troughs. A plurality of reinforces is attached to the damper body. Each reinforce includes a woven fabric in the form of a mesh extending in a direction different from that of the damper body and having a wavy cross-section for closely fitting over the wavy configuration of the damper body. Each reinforce is fixed to the damper body by for example sewing and extends between inner and outer circumferences of the ring of the damper body. The reinforces are arranged in a symmetric manner. Since the meshes of the reinforces are extended in different direction from that of the damper body, the damper body is effectively reinforced against cracking and/or breaking caused by long-term high frequency vibration. The life span of the damper can thus be extended.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
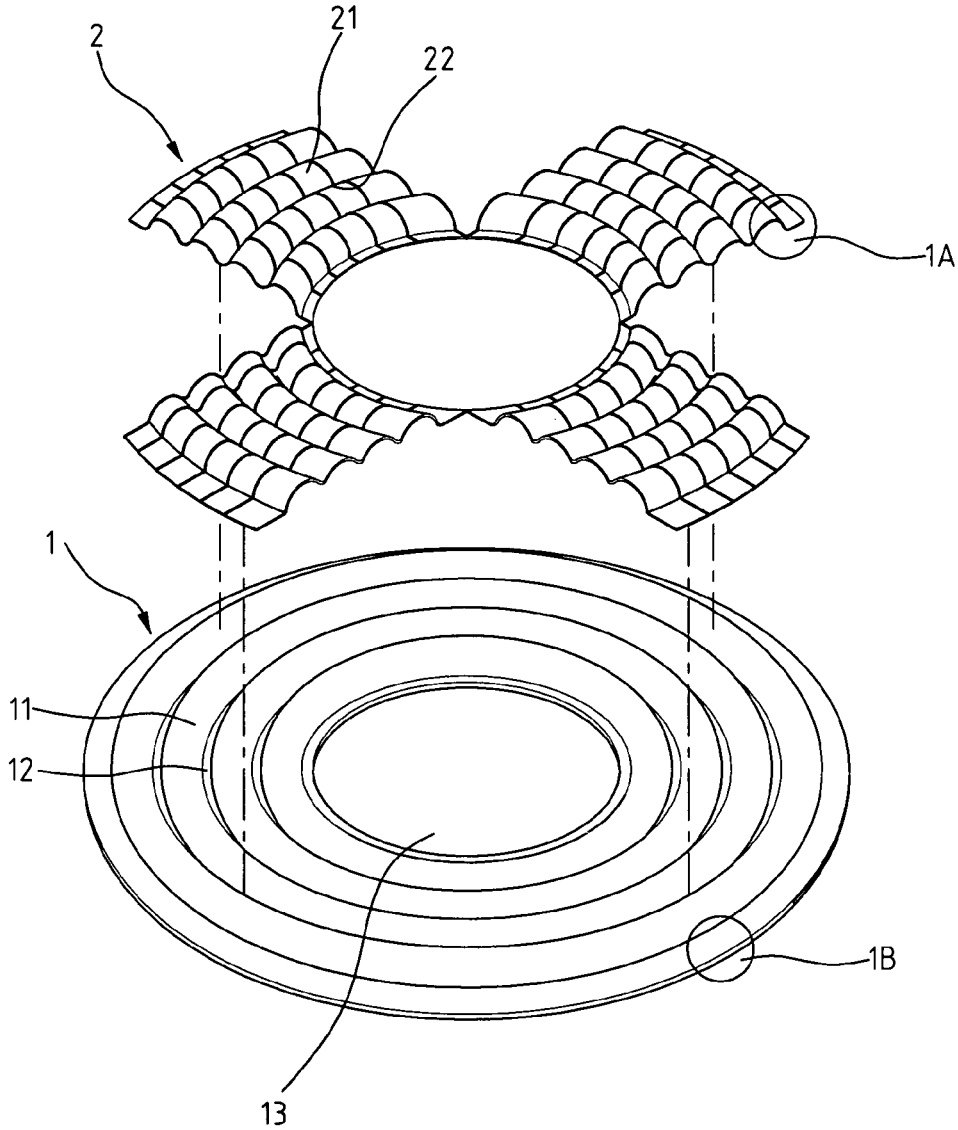
FIG. 1 is an exploded view of a reinforced damper constructed in accordance with the present invention.
Figure 1A:
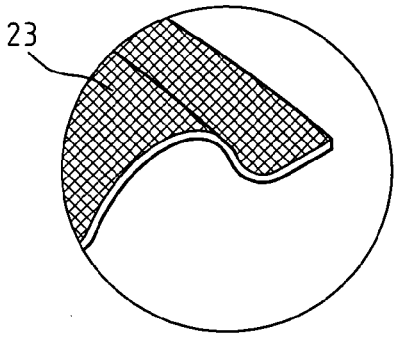
FIG. 1A is an enlarged view of encircled portion 1A of FIG. 1.
Figure 1B:
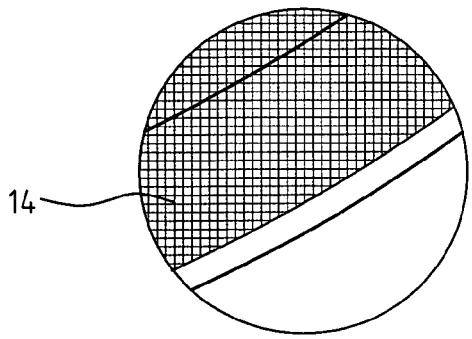
FIG. 1B is an enlarged view of encircled portion 1B of FIG. 1.

Referring to the drawings and in particular FIGS. 1, 1A, 1B, 2 and 2A, a reinforced speaker damper constructed in accordance with the present invention comprises a ring-shaped damper body 1 and a plurality of reinforces 2. The ring 1 is comprised of a woven fabric in the form of a mesh having rectangular openings 14 extending in a given first direction. The fabric is press-molded to form a wavy cross-section having alternating ridges 11 and troughs 12. The ring 1 defines a central bore 13.

Each reinforce 2 comprises a piece of woven fabric press-molded to form a wavy cross-section substantially corresponding to the wavy cross-section of the damper ring 1 and having alternating ridges 21 and troughs 22. The fabric of the reinforce 2 is in the form of a mesh having rectangular openings 23 extending in a second direction, which is different from the first direction in which the mesh openings 14 of the damper ring 1 extend.

Figure 2:
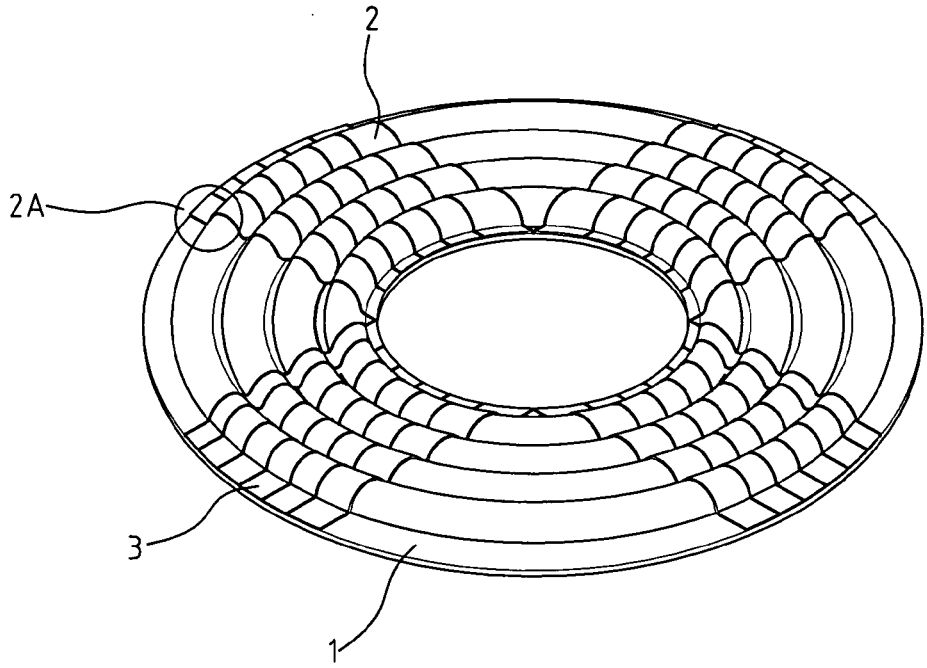
FIG. 2 is a perspective view of the reinforced damper of the present invention.
Figure 2A:
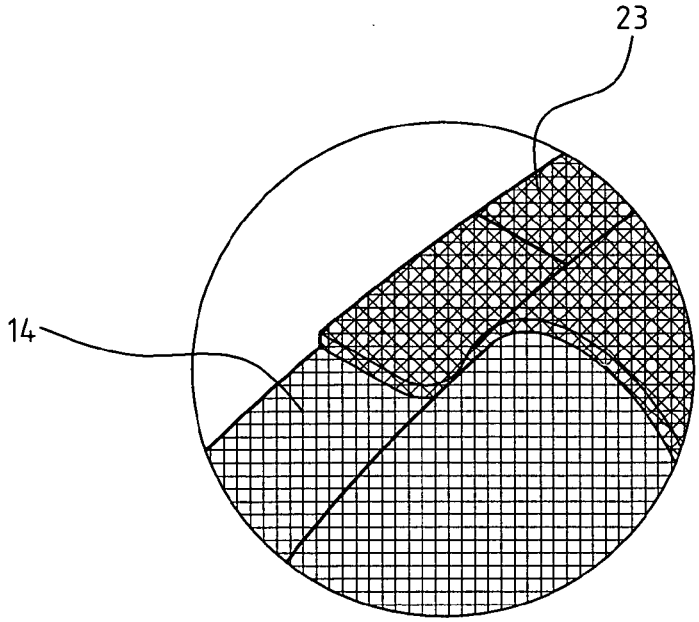
FIG. 2A is an enlarged view of encircled portion 2A of FIG. 2.

The reinforces 2 are positioned on a major surface of the ring and are arranged symmetric about a center axis of the ring 1 with the ridges 21 and troughs 22 of the reinforces 2 closely engaging the corresponding ridges 11 and troughs 12 of the ring 1. The reinforces 2 are sized to extend between an inner circumference of the central bore 13 of the ring 1 and an outer circumference of the ring 1. Preferably, the reinforce 2 has inner and outer edges that are curved in correspondence with the inner and outer circumferences of the ring 1. As shown in FIGS. 1 and 2, the preferred embodiment of the reinforces of the invention have four reinforces arranged in a symmetric way about the center axis of the ring and extending from the inner circumference to the outer circumference of the ring in four different directions. The reinforces 2 are then fixed to the ring 1 in any suitable manner, such as sewing. The arrangement of the reinforces 2 on the ring 1 is preferably done in such a way that the second direction in which the mesh openings 23 of the reinforces extend is different from the first direction in which the mesh openings 14 of the ring 1 extend. This enhances the reinforcing strength of the reinforces 2 on the ring 1.

Figure 3:
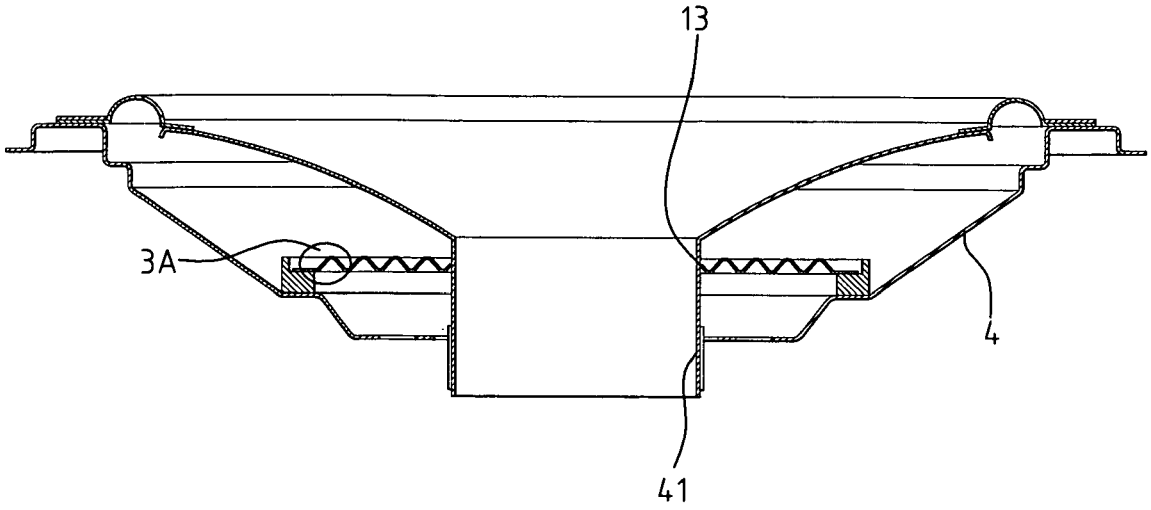
FIG. 3 is a cross-sectional view of a speaker in which the reinforced damper of the present invention is embedded.
Figure 3A:
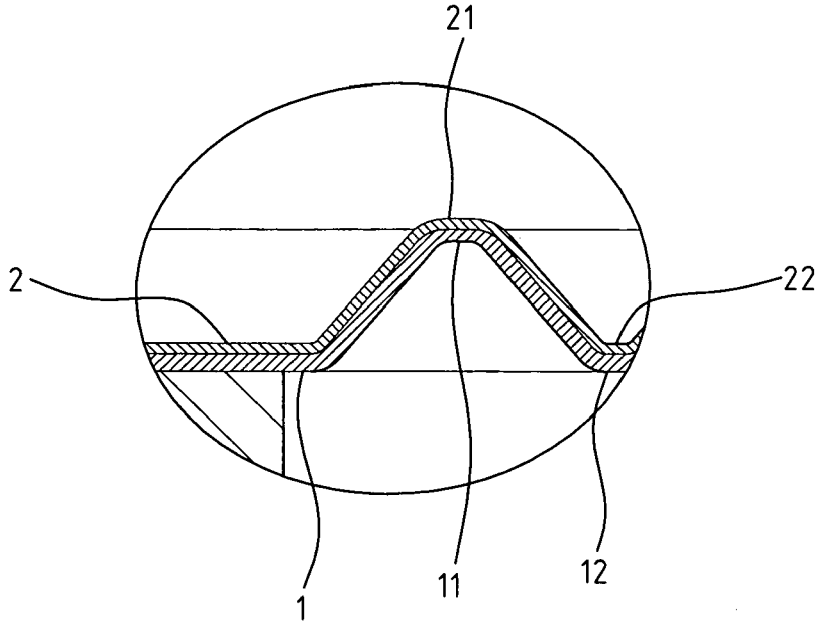
FIG. 3A is an enlarged view of encircled portion 3A of FIG. 3.
Figure 4:
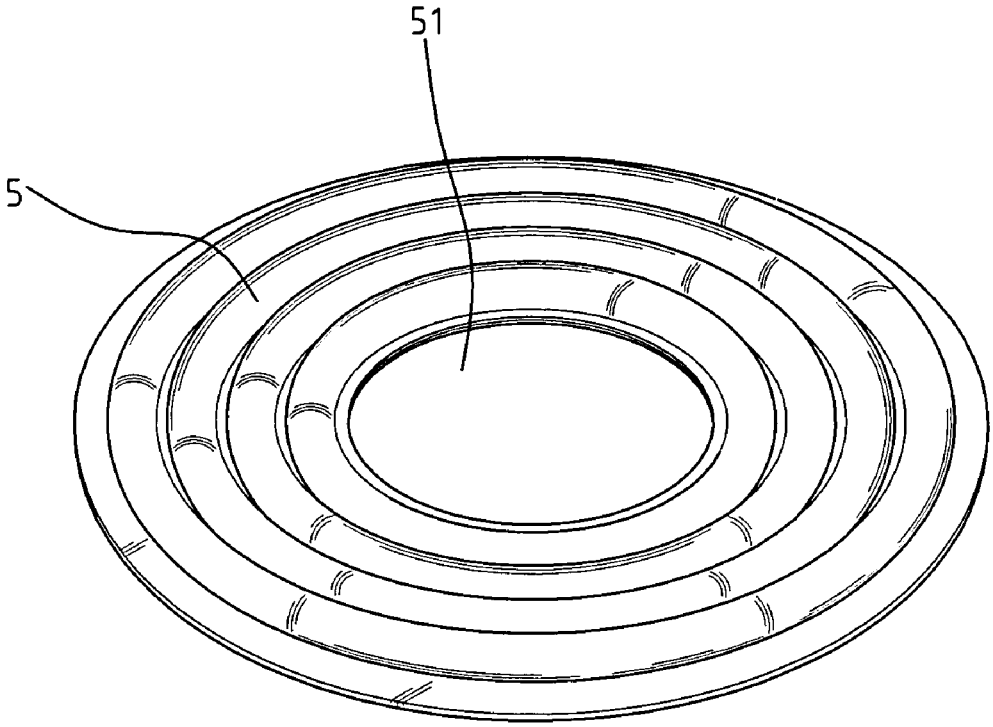
FIG. 4 (PRIOR ART)
FIG. 4 is a perspective view showing a conventional speaker damper.
Figure 5:
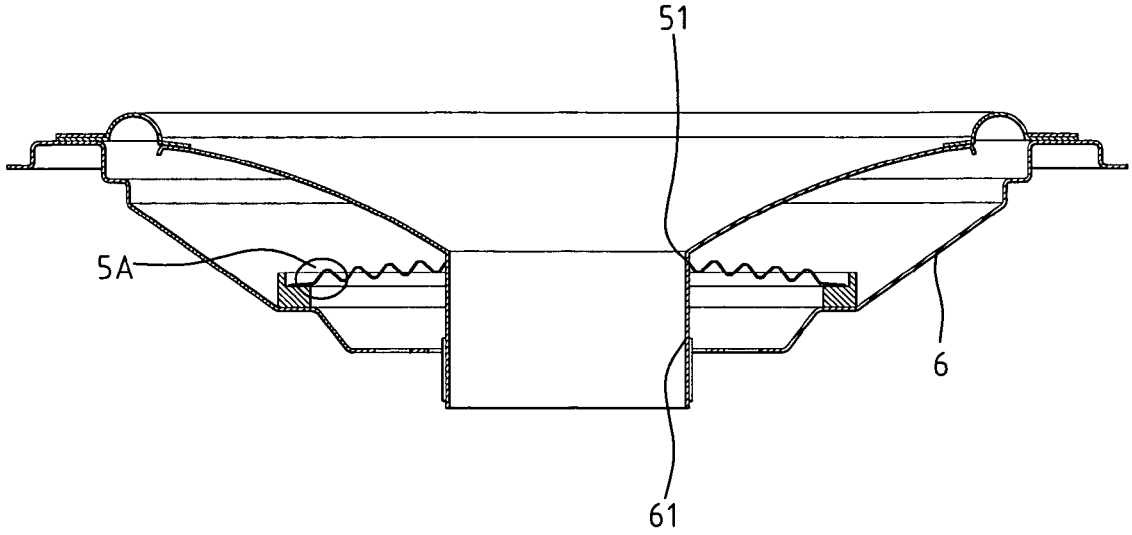
FIG. 5 (PRIOR ART)
FIG. 5 is a cross-sectional view of a speaker comprising the conventional damper.
Figure 5A:
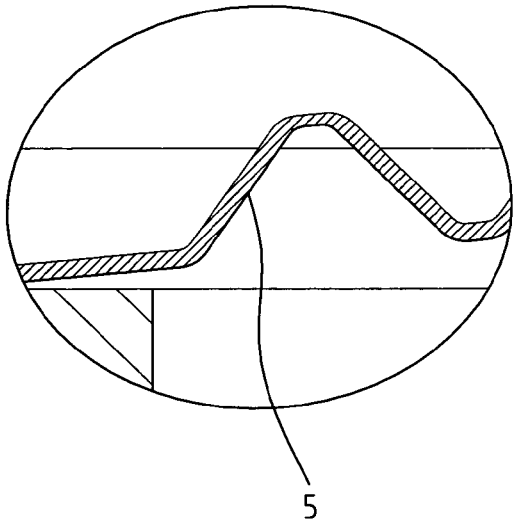
FIG. 5A (PRIOR ART)
FIG. 5A is an enlarged view of encircled portion of FIG. 5.

Also referring to FIGS. 3 and 3A, the reinforced damper is embedded in a speaker, generally designated with reference numeral 4. The speaker 4 comprises a coil 41 substantially located at a center of the speaker. The central bore 13 of the ring 1 of the damper is fit over the coil 41 and the outer circumference of the ring 1 is fixed to a cone (not labeled) of the speaker 4. When the speaker 4 is actuated, the coil 41 is energized and a magnetic field is induced in the coil 41, which causes vibration of a film (not labeled) of the speaker, giving off sound wave propagating through the surrounding air. The sound wave eventually reaches the damper, causing vibration of the damper. The reinforces 2 extending between the inner and outer circumferences of the ring 1 and comprising meshes extending in different direction from that of the ring 1 effectively reinforce the ring 1, especially at the inner circumference that is subject to concentrated vibration energy. Thus, occurrence of cracking and/or breaking along the inner circumference of the ring 1 can be effectively suppressed and the life span of the damper can be extended.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A reinforced damper comprising:

a ring-shaped damper body having an outer circumference and an inner circumference, the inner circumference defining a central bore, and the damper body comprising a fabric in the form of a mesh having rectangular openings extending in a first direction; and at least one reinforce attached to a surface of the damper body and having an end extending to the inner circumference of the damper body, the reinforce comprising a fabric in the form of a mesh having rectangular openings extending in a second direction;

wherein the rectangular openings of the damper body and the rectangular openings of the reinforce extend in different directions.

2. The reinforced damper as claimed in claim 1, wherein the reinforce extends between the inner and outer circumferences of the damper body.

3. The reinforced damper as claimed in claim 1, wherein the reinforced damper comprises four reinforces arranged in a symmetric way with respect to a center axis of the ring-shaped damper body and extending from the inner circumference to the outer circumference in four different directions.

4. The reinforced damper as claimed in claim 1, wherein the damper body has a wavy cross-section comprised of alternating ridges and troughs and wherein the reinforce has a wavy cross-section comprised of alternating ridges and troughs closely mating the ridges and troughs of the damper body.

5. The reinforced damper as claimed in claim 1, wherein the reinforce is attached to the damper body by sewing.

6. The reinforced damper as claimed in claim 1, wherein a plurality of reinforces is attached to the damper body and extends from the inner circumference to the outer circumference in different directions.

7. The reinforced damper as claimed in claim 6 wherein the reinforces are arranged in a symmetric manner.

8. The reinforced damper as claimed in claim 2, wherein the reinforce has an inner edge and an outer edge, which are curved in correspondence with the inner and outer circumference of the damper body.

* * * * *